US005361960A

United States Patent [19]

Fokos et al.

[11] Patent Number: 5,361,960

[45] Date of Patent: Nov. 8, 1994

[54] OFF-LINE WEB FINISHING SYSTEM WITH SPLICE AND MISSING MARK STABILITY

[75] Inventors: Robert Fokos, Wayland; Robert M. Williams, Canton; Orfeo J Salvucci, Holbrook, all of Mass.

[73] Assignee: Sequa Corporation, Hackensack, N.J.

[21] Appl. No.: 939,020

[22] Filed: Sep. 20, 1992

Related U.S. Application Data

[63] Continuation-in-part of Ser. No. 882,832, May 14, 1992, Pat. No. 5,224,640, which is a continuation of Ser. No. 467,941, Jan. 22, 1990, Pat. No. 5,129,568.

[51] Int. Cl.[5] ..... B65H 23/0; B65H 23/18; B41F 13/24

[52] U.S. Cl. ..... 226/2; 226/27; 226/40; 101/248

[58] Field of Search ..... 226/24, 27, 32, 33, 226/34, 35, 36, 40, 2; 101/181, 248

[56] References Cited

U.S. PATENT DOCUMENTS

| | | | |
|---|---|---|---|
| 2,326,931 | 8/1943 | Dalton et al. | 226/32 |
| 3,102,471 | 9/1963 | Auer et al. | 101/181 |
| 3,218,969 | 11/1965 | Nagel | 101/181 |
| 3,556,509 | 1/1971 | Crum | 270/52 |
| 3,701,464 | 10/1972 | Crum | 101/181 |
| 3,841,216 | 10/1974 | Huffman | 101/181 |
| 3,915,090 | 10/1975 | Horst et al. | 101/181 |
| 3,998,156 | 12/1976 | Zimmer | 101/181 |
| 4,078,490 | 3/1978 | Biggar, III | 101/248 |
| 4,085,674 | 4/1978 | Biggar, III | 101/248 |
| 4,096,801 | 6/1978 | Martin | 101/181 |
| 4,452,140 | 6/1984 | Isherwood et al. | 101/181 |
| 4,473,009 | 9/1984 | Morgan | 226/40 |
| 4,485,949 | 12/1984 | Gebhart et al. | 226/45 X |
| 4,552,608 | 11/1985 | Mothmann et al.. | 226/27 X |
| 4,572,074 | 2/1986 | Guaraldi | 101/181 |
| 4,694,749 | 9/1987 | Takeuchi et al. | 101/426 |
| 4,781,317 | 11/1988 | Ditto | 226/27 |
| 4,824,503 | 4/1989 | Wilen | 156/204 |
| 4,852,785 | 8/1989 | Bettendorf et al. | 101/181 |
| 4,994,975 | 2/1991 | Minschart | 15/364 |
| 5,129,568 | 7/1992 | Fokos et al. | 226/27 |
| 5,224,640 | 7/1993 | Fokos et al. | 226/27 |

FOREIGN PATENT DOCUMENTS 0313541 4/1989 European Pat. Off. .

*Primary Examiner*—Daniel P. Stodola
*Assistant Examiner*—Michael R. Mansen
*Attorney, Agent, or Firm*—Mitchell D. Bittman

[57] ABSTRACT

An off-line web finishing system performs plural functions on a pre-printed and rewound web at a series of pieces of equipment arranged in a line. Tension in the web is set at a variable infeed at a substantially constant value that is sufficient to facilitate handling of the web. A common web-transport system drives all draw rolls in the line in unison, at substantially the same speed, and without slippage between the web and the rolls. A second drive system, preferably one using a second drive shaft, rotates the function cylinders of one or more registration sensitive pieces of equipment in unison. A continuously adjustable variable transmission is operatively connected between the secondary line shaft and a main line shaft for the web transport. A control system adjusts the variable transmission. It includes a central microprocessor, an optical scanner associated with each function cylinder, and an encoder to measure the speed of rotation of the function cylinder. Each scanner senses adjacent registration marks on the web that define each impression. Control logic compares the sensed speed in the time interval T for one impression to pass on and produces an output control signal if the proper speed is not sensed and if the misregistration is less than a predetermined limit.

7 Claims, 4 Drawing Sheets

OFF-LINE WEB FINISHING SYSTEM WITH SPLICE AND MISSING MARK STABILITY

REFERENCE TO RELATED APPLICATIONS

This application is a continuation-in-part of U.S. Ser. No. 07/882,832 filed May 14, 1992, now U.S. Pat. No. 5,224,640, which in turn is a continuation of U.S. Ser. No. 07/467,941, filed Jan. 22, 1990, now U.S. Pat. No. 5,129,568.

BACKGROUND OF THE INVENTION

This invention relates in general to printing. More specifically, it relates to web finishing, and in particular to off-line web finishing of pre-printed and rewound webs.

In the manufacture of magazines, mailing inserts, envelopes, brochures and many other printed products, the product is printed on a web of paper, traveling through a printing press at high speed, up to 2,000 feet per minute. In most printing applications, and certainly those where there is color printing or where the web is run through the press more than once, it is essential to maintain a very precise registration between the web and the printing cylinders acting on the web. This is a problem because paper is elastic and in most modern printing presses such as commercial web offset presses the paper is moistened by ink and water and then heated in dryer. This wetting and drying causes unpredictable variations in the properties of the paper, including its length, which creates a problem in maintaining registration between the web and the equipment acting on it.

In printing presses, the standard approach to maintaining registration during a second or successive run has been to stretch the web until it is back in registration, or to hold it in registration against a shrinkage associated with drying. The former technique is the most common approach. For example, in the printing of newspapers with color. The color is first printed on the web, but printed "short", that is, the length of the impression or pattern printed on the web by one revolution of a print cylinder is slightly less than the desired final length. In a second pass, when black ink only is printed on the web, the web is stretched between a pair of draw rolls to the desired full impression length. The web has registration marks printed on it at regular intervals. Optical scanners detect the marks, compare the sensed impression length with the desired value, and produce an electrical control signal. The value and sign of the signal is used to increase or decrease the speed of the downstream roll, and thereby adjust the length of the web. This mode of adjustment, which is perhaps the most widely used, requires a slippage between the draw roll, e.g. a chill roll following the dryer, and the web, but there can be no slippage between the print cylinders and the web. In other systems the adjustment is made by changing the path length of the web between sets of draw rolls, as with a dancer roll that moves under control of the registration correction signal.

In U.S. Pat. No. 4,096,801 to Martin the web in a printing press is secured against slippage with respect to all of the rolls. The dryer in the press is assumed to produce a shrinkage of the web. By drawing the web at a uniform speed throughout the press, the web is automatically stretched back to its initial length. In other words, Martin "locks" the printing and draw roll cylinders onto the web and thereby secures the web in a known relationship (registration) with respect to the cylinders operating on it.

Registration is also a very significant problem in web finishing, as opposed to web printing. Web finishing is the processing of a printed web to a finished product such as a multi-page "signature" which forms a magazine, or a part of a magazine. The processing often includes folding, perforating, spot application of glue, die cutting and rotary cutting. These functions are usually performed by a series of machines arranged in a line. These operations can be performed "in-line", that is, receiving a freshly printed web directly from a printing press, or "off-line", that is, receiving the web from a rewound, pre-printed roll. In recent years finishing has been principally in-line. A principal reason for this is that if the printed web is wound and stored, because the paper is elastic, responsive to environmental conditions such as humidity and temperature, and has been strained by processing, its properties change over time. For finishing, a crucial problem is that once stored the dimensions of the paper change unpredictably and non-uniformly, which of course changes the repeat length of the pattern along the web. The pattern may shrink, expand, or do both within the same rewound web. In-line finishing avoids the problems by not allowing time for the web to change.

In-line finishing has also found favor because prior off-line finishing set preconditions on how the web is printed in order to allow finishing of a rewound roll. A typical precondition is requiring that the web be printed "short" so that it can be stretched back into registration in the finishing line. Ideally, the printing process should be completely independent of the finishing process; any roll from any printing press should be able to be finished along with other rolls from other presses of the same repeat length. This objective is not attainable with current off-line systems.

In-line web finishing, however, has several significant disadvantages. First, it is too slow to be operationally linked to modern printing presses without significant costs. A typical operational speed of a press is up to 2,000 feet per minute, whereas an in-line finishing system typically operates at up to 1,000 feet per minute. The in-line web finishing therefore cuts the productivity of the entire printing press about in half. Second, an in-line finishing system has a significant make-ready time, typically 8 to 48 hours, as a series of pieces of equipment are adjusted to very tight tolerances. While the finishing equipment is made ready, the printing press, which is a substantial capital investment, is idle. This further reduces the productivity of the entire printing operation. In the known newspaper printing system where black ink is applied in a second pass there is only one operation, the printing of black ink; a finishing line will normally perform 20 to 30 operations on the web in one pass.

Several other design problems have plagued automated off-line finishing operations. One is that the tension used to stretch the web to maintain registration can be sufficient to weaken or even break the web, particularly lightweight webs such as those used to form airmail envelopes. Web breaks are costly since some printed material is wasted and because the line is down while the web is refed through the line and registration adjusted. Another problem is maintaining registration despite 1) rapid, often local, changes in the repeat length—which requires a fast dynamic response—and 2) accumulating registration errors of the same type (long or short repeat lengths) that cannot be accommodated by registration adjustment mechanisms in the system.

As noted above, in general the prior art solution to the registration problem has been to stretch the web, and therefore increase the tension in the web, until it is in registration. The most widely used arrangement is to have a variable speed draw roll operating under the control of an optical scanner that looks at the registration marks. This system works, but it does not work for light weight paper, it does not have a fast dynamic response time and while it may be acceptable for simple printing and finishing operations, e.g. where the only operation is to print black ink, it is not well suited for use in a high speed finishing line which performs, on average 20 to 30 operations.

With regard to the response time, conventional scanning equipment monitors the web once during the passage of multiple impressions, usually in the range of 10 to 100 depending on factors such as the press or line speed, the size of the impressions, and the capabilities of the monitoring equipment, and the susceptibility of the registration control system to "hunting". In web finishing, there can be significant variations in the registration between these monitorings and there can be cumulative errors which can accumulate to a significant registration error before the situation is monitored, let alone corrected. Moreover, even if one monitors more often, not all control system and adjustment equipment can respond to the rapid variations quickly enough. The result can be that the adjustment system hunts but cannot keep up with the corrections required. Also, where the errors are cumulative, the system may not be able to keep up with the ever growing misregistration. With respect to the number of operations performed in a finishing line, the problem is that if the tension in the web is adjusted at one station to produce a correct registration, this change in tension will fight against the registration of the web at other stations where other operations are performed. In short, tension adjustments at one location fight adjustments at another location leading to increased difficulties in maintaining registration throughout the finishing line, and to an increased likelihood that the tension will reach a level sufficient to break the web.

As noted above, in some systems registration is maintained by adjusting the paper path length as it traverses the printing press or finishing line. A common technique is to pass the web over a movable, pro-loaded idler or "dancer" roll so that changes in registration can be affected by changes in the speed at which the paper is moving with respect to the equipment at different points, which results in changes in the total length of the paper in the press or line. Path length adjustments work for certain applications, but they cannot deal with the accumulating adjustments required for off-line web finishing. For example, if a web should have a repeat (impression) length of 630.0 mm, but is consistently printed long at 630.25 mm, during the passage of 100 impressions, in a few seconds, there is a cumulative misregistration of 25 mm, about one inch. While a path length change can in theory compensate for this cumulative error, it cannot do so indefinitely. In the case of the dancer roll, its travel will eventually reach an extreme limit position and it will be unable to make further compensating movements.

U.S. Pat. Nos. 4,078,490 and 4,085,674 to Biggat compensate for misregistration by changing the phase angle between an output gear (acting through a worm gear) and a line shaft. Registration units operate at each station. In the '674 patent, for example, a registration unit for a die cutting station has a motor that rotates a sleeve relative to a shaft of a first cylinder. This rotation shifts the phase of a drive gear and a die cylinder relative to the first cylinder. There is no apparent control of web tension to hold it at a constant value. There is likewise no way to deal with cumulative errors other than through constant adjustment of the phase angle. While this is theoretically a solution, in practice known systems cannot keep up with the accumulation errors that may be encountered in processing rewound webs.

U.S. Pat. No. 4,452,140 to Isherwood et al. describes another system, one using a dancer roll to adjust paper path length, as discussed above. In FIG. 2 Isherwood et al. show a further registration adjustment at a downstream processing station. This further registration can be accomplished by a differential gear assembly to introduce phase angle adjustments. The web is monitored by a single detector. There is no teaching to maintain the tension in the web constant.

U.S. Pat. No. 3,841,216 to Huffmann discloses a system for registration control on a second pass of a printed web, with registration marks, through a printing press or "processing device". Huffmann adjusts first by metering the web at the infeed rolls. Other variations, termed by Huffmann as a "stretch factor", are compensated by a proportional registration shaft Z driven by a differential 106 responsive to sensed registration errors. The signals control signals reflect inputs from an electric eye and an encoder. Rotation of the shaft Z alters the web path length (FIG. 4) and the phase relation of the blanket cylinders of printing stations in the press. The Huffmann system also adjusts the feed rate of the web to control registration. These adjustments change tension in the web. Huffmann provides a hybrid system which controls registration using both adjustments in web tension and in paper path length. However, it is limited in its ability to compensate for cumulative errors to the same extent as the Isherwood path length adjustment system. Also, it is in essence a more sophisticated variation on the standard "stretch into register" approach. The web is pulled to achieve registration.

Web splices and missing registration marks are two conditions which have proven especially difficult for known automatic registration maintenance systems for off-line finishing equipment. If corrections along a finishing line are made in unison, a splice sensed upstream in the line will cause a correction in the registration along the entire line. Since the web downstream of the splice is in fact in registration, the "correction" will cause it to go out of registration. As a result, a length of web equal to the length of the finishing line, typically three hundred feet, becomes waste scrap. In addition, the entire line will continue to output scrap as the registration system hunts to bring the function cylinders into registration with the spliced in web. This resetting of the registration can produce additional hundreds, or thousands, of feet of scrap depending on the length of time it takes to reacquire registration and the speed of travel of the web through the line. This reacquisition of registration can be further complicated by the fact that a new web spliced onto another web can have reacted differently to atmospherics resulting in a different repeat length.

Missing registration marks can occur when a pressman cleans the blanket of the press as the web is initially printed. A "loss of mark" condition causes the registration system to hunt for a mark, and then when it finds one, reset to it and to successive marks. The web continues to run during the hunting and resetting. This produces waste scrap. Also, conventional controls used on, or adapted from, systems used on web presses increase the hunting and reset times. In web presses, these controls can safely look for a mark within a very narrow "window" on the web. This is because marks will be reliably within a narrow window if the web issues directly from the web press to an in-line finishing system. However, in an off-line situation, where the web is wound, stored, and later unwound for finishing, variations in the web dimensions due to atmospherics destroy the reliability of finding a mark in any narrow window. More generally, conventional web press and in-line control systems adapted for use in off-line systems have proven to be costly, somewhat unstable, and poor in adapting to highly irregular web conditions such as splices and missing registration marks.

It is therefore a principal object of the present invention to provide a registration control arrangement for off-line finishing of printed webs which deal readily with splices and a loss of mark condition.

Another object is to provide a registration control system for off-line finishing of a rewound, pre-printed web that is highly stable, even under extremely abnormal web conditions.

A further object is to provide registration control system with the foregoing advantages that is less costly than current controls for the same or similar equipment.

Another object is to provide a registration control system with the foregoing advantages that has a good dynamic response to cumulative and localized errors.

Still another object is to provide a control system with the foregoing advantages that reduces the amount of printed web wasted in web finishing and therefore lowers the cost of producing finished printed products.

SUMMARY OF THE INVENTION

A web finishing system has a series of pieces of equipment arranged in a line to perform multiple functions on a printed web traveling through the line at a high speed, preferably about 1,000 feet per minute, but as high as 2,000 fpm. At least certain pieces of the equipment, such as perforators, pattern gluers, die cutters and rotary cutters, are registration sensitive. Each piece of equipment has at least one function cylinder that acts intermittently on the web in precise coordination with a series of impressions printed on the web. Each impression extends longitudinally along the web for a repeat length. The web also has registration marks printed on it. Some registration marks may be missing; the web can include splices.

A web transport system that drives all of the draw rolls in the line at substantially the same speed, preferably from a common line shaft. There is no slippage between the web and the draw rolls and there is no overdrive tending to stretch the web to a degree that is sufficient to correct misregistrations; the tension set at an infeed remains substantially constant throughout the line. There is no slippage between the web and these draw rolls. The web infeed preferably sets the tension at as low a value as is necessary to handle the web.

The function cylinders engage the web only intermittently, therefore their surface speed can vary from that of the web. A second drive system rotates all of the function cylinders. In a preferred form it includes a second line shaft that drives all of the function cylinders in unison. A continuously variable transmission is connected between the main and second line shafts. Preferably the second line shaft follows and is driven by the main line shaft through the variable transmission.

Preferably each function cylinder has an optical scanner and an encoder associated with it that produce input control signals to a microprocessor controller. The scanner produces a signal when it senses a registration mark. One mark signals the start of an impression; the next successive mark signals the end of that impression and the start of the next impression. These successive signals generate a measure of a time interval T corresponding to the passage of one impression past that scanner. As the length of the impression varies, the value of the interval T also varies.

The encoder produces a known number of pulses during each complete revolution of the function cylinder. For each run, the function cylinder should undergo a known number of revolutions during the passage of one impression, and therefore produce a known number (N) of pulses. If the microprocessor detects a different number of pulses, it generates an appropriate error correction signal that controls the variable transmission that in turn produces a corresponding change in the relative speeds of rotation of the main and second line shafts. The microprocessor preferably averages readings from multiple impressions to produce a correction signal. Also, it produces no error correction signal if the magnitude of the sensed error exceeds preset limits. This allows the finishing line to run without correction to pass a splice or to continue to finish printed web with no registration marks. In the preferred form the secondary drive includes a conventional phasing gear coupled between the second line shaft and each of the function cylinders. These gears, operating in response to the sensed registration marks as read by the associated scanner, produce a phase adjustment, that is, a change in the angular position of each function cylinder. This phase adjustment is in addition to the continuous speed ratio adjustment between the web and the function cylinder to correct for deviations in the repeat length (cumulative errors).

These and other features and objects of the present invention will be more fully understood from the following detailed description which should be read in light of the accompanying drawings.

DETAILED DESCRIPTION OF THE PREFERRED EMBODIMENTS

Figure 1:
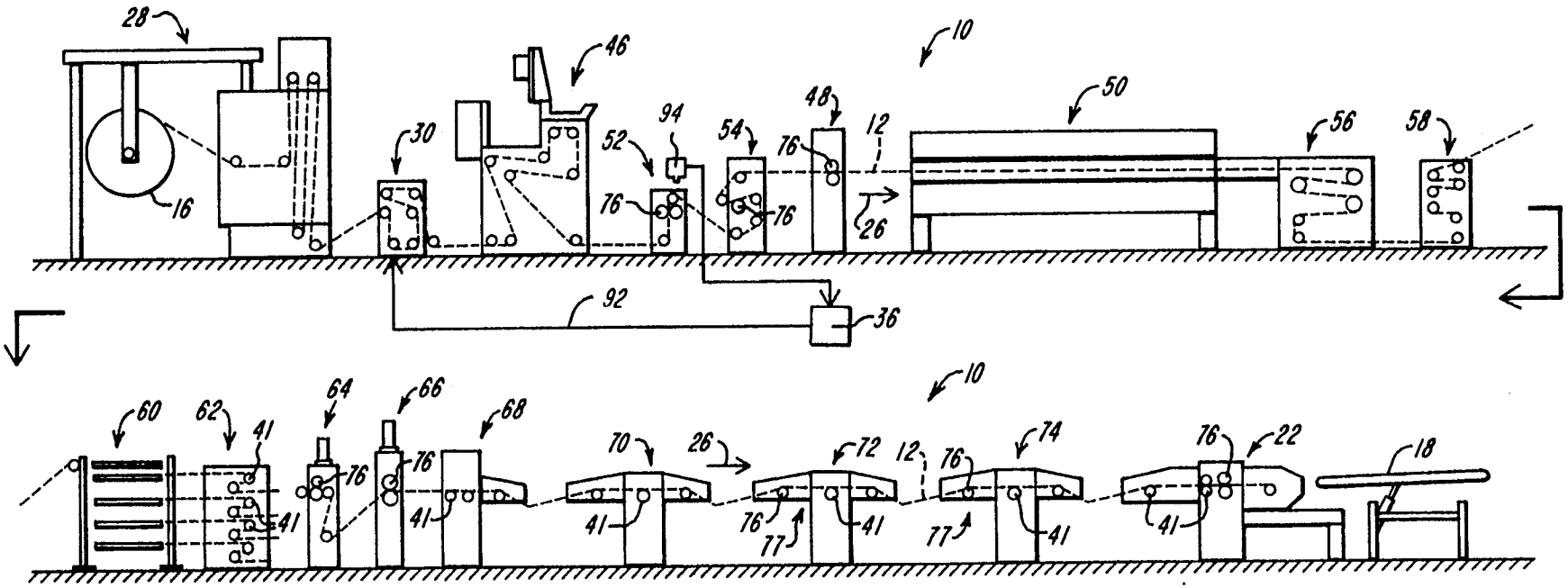
FIG. 1 is a view in side elevation of an off-line web finishing system according to the present invention.
Figure 2:
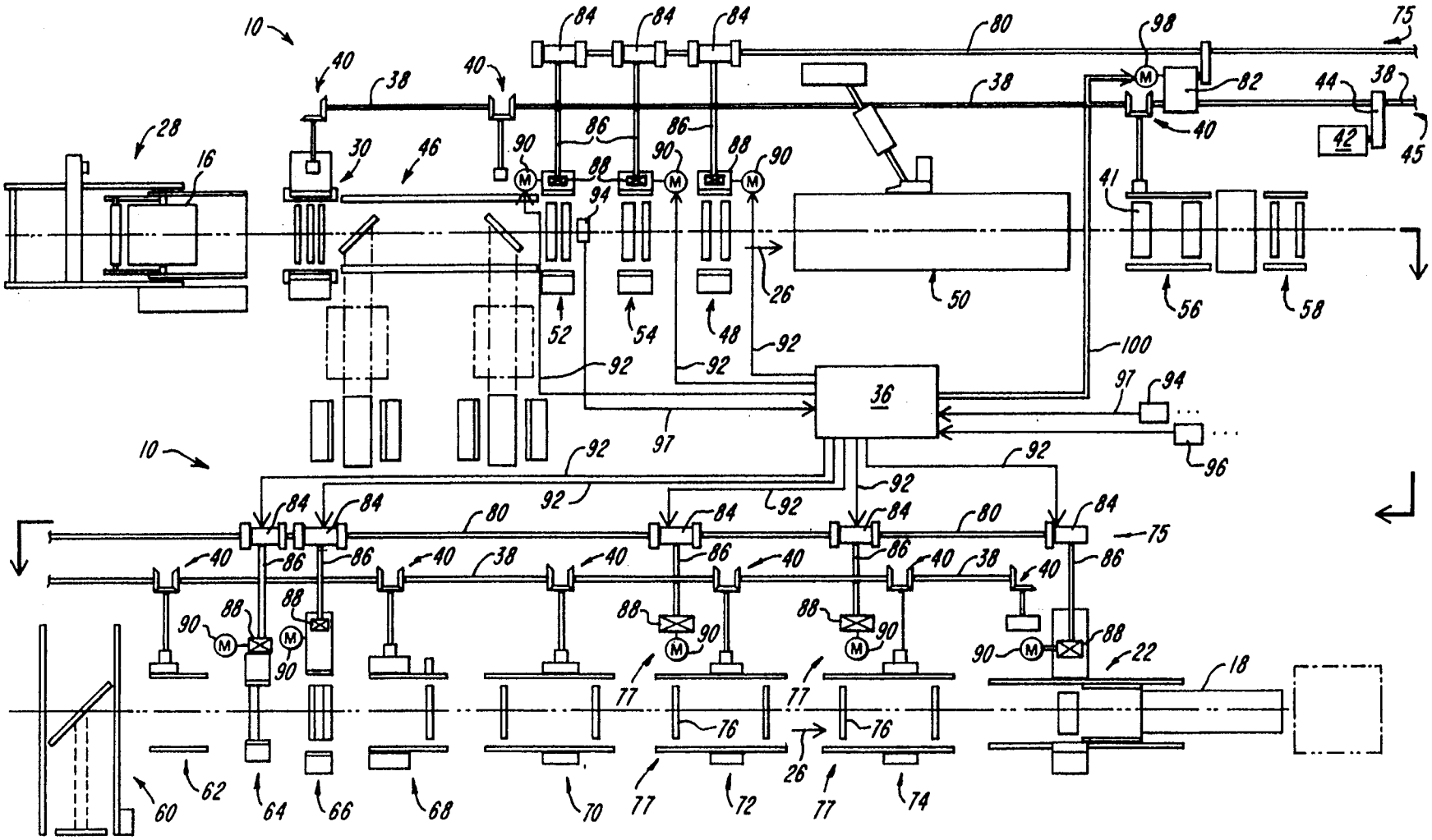
FIG. 2 is a top plan view corresponding to FIG. 1.
Figure 3:
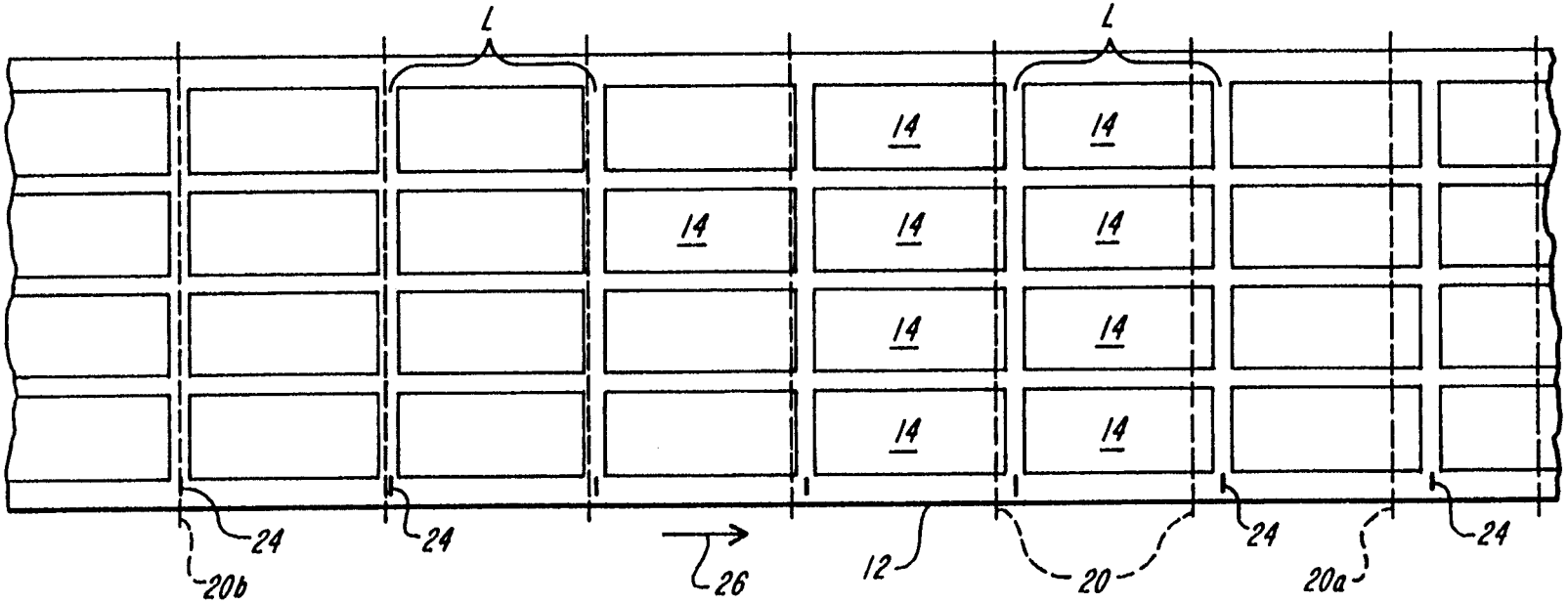
FIG. 3 is a top plan view of the web shown in FIGS. 1 and 2 having a succession of impressions printed long with an accumulating misregistration error.
Figure 5:
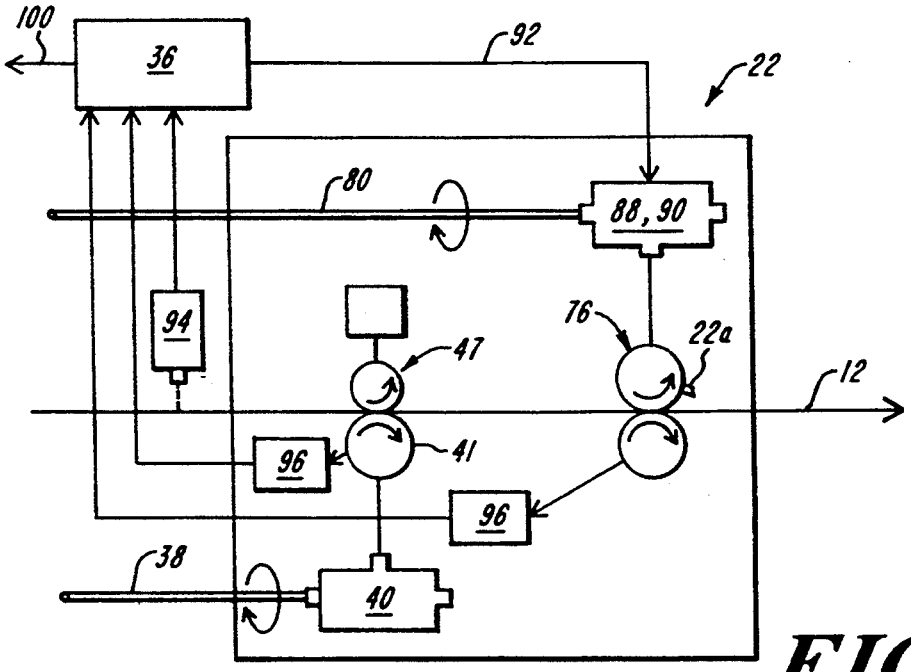
FIG. 5 is a highly simplified schematic view in side elevation of the rotary cutter shown in FIGS. 1 and 2.

FIGS. 1, 2 and 5 show an off-line web finishing system 10 according to the present invention. A web 12 previously printed with a series of impressions 14 (FIG. 3) is unwound from a roll 16 and fed through the finishing line. The line performs multiple functions on the web, usually more than twenty, and delivers a processed product, such as a signature used to form a magazine, a specialized direct mail solicitation with a tear out return mail form, or an envelope, to a final delivery conveyor 18 at the end of the line. The impressions have a repeat length L (FIG. 3) along the longitudinal axis of the web which typically corresponds to the circumference of a print cylinder, 630 mm being a common value. Because of the elastic and environmentally sensitive nature of paper, the repeat length of the impressions 14 can and usually will vary from the expected length. FIG. 3 shows a cumulative error where the impressions are each printed long. The transverse dashed lines 20 illustrate where a finishing function, such as the operation of a rotary cutter, will fall on the web in the absence of correction. While the problem as illustrated in FIG. 3 is exaggerated, it clearly demonstrates how cumulative errors of the same type (a long or short repeat length) can rapidly lead to a cut 20*a* within an impression, not between impressions as shown at 20*b*. The web so cut, within an impression, is not usable. Besides the cumulative errors, the paper may expand or contract locally in a highly unpredictable manner resulting in localized and rapidly changing positional errors that can also be of a sufficient magnitude to result in an operation being performed on the web so as to destroy the product. Special, highly disruptive conditions arise when the web is spliced or when registration marks are missing altogether.

Figure 4A:
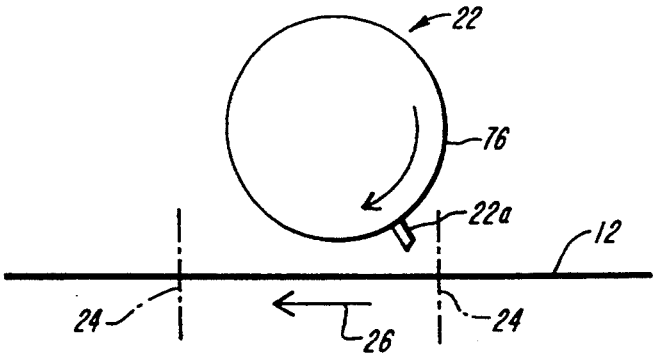
FIGS. 4A and 4B are schematic views in side elevation of a rotary cutter rotating in coordination with the moving web shown in FIGS. 1–3.
Figure 4B:
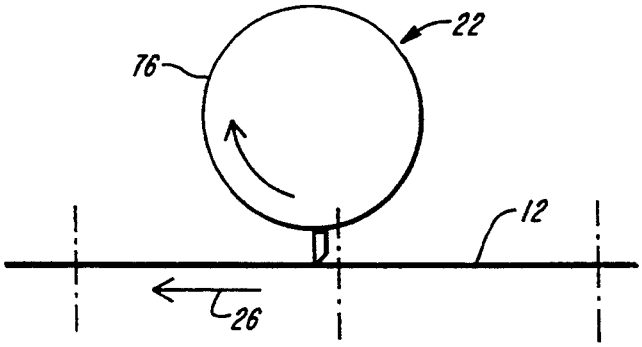

FIGS. 4A and 4B illustrate in a simplified manner the timing between the operation of a function cylinder, here a rotary cutter 22, and the web. In FIGS. 4A and 4B dashed lines 24 represent the location of registration marks on the web. (While this discussion refers to conventional registration marks on the web, it will be understood that the term "registration mark" can include some distinctive portion of the printed impression itself.) The web moves in the direction of arrow 26. In FIG. 4A a blade 22*a* is rotating toward a cutting position where it impacts on the web for an instant. In FIG. 4B the blade has rotated in conjunction with an advance of the web to cut the web at point C. This illustrates a misregistration or timing error since the cut occurs ahead of the desired location, here taken to be the registration mark.

The system 10 begins with a splicer 28 that feeds the rewound web from the roll 16 to an infeed device 30 having draw rolls that in turn feed the web to the rest of the line of finishing equipment. The infeed device, such as the web guide and infeed sold by MEG as model 640H, sets the tension in the web. The desired value for the web tension is selected at the infeed and it varies the web feed rate to maintain the tension at the desired value. In the presently preferred form the draw rolls of all of the equipment in the system 10 are driven in unison from a common line shaft 38. Conventional gear boxes 40 couple the line shaft to shafts that each drive one of the draw rolls 41 (not all of which are shown in FIG. 2). A motor 42, preferably a 75 HP D.C. motor or the like, provides the motive power for the line shaft 38 via a transmission belt 44. The motor 42, line shaft 38, gear boxes 40, and draw rolls 41 form a web transport system 45 that conveys the web 12 through the system 10 at a substantially constant tension, at high speed, e.g. 1,000 to 2,000 fpm. (It is possible to introduce small variations in the speed of the draw rolls to maintain the web taut, but these variations are not sufficient to elongate the web to the degree necessary to maintain registration.) The set, substantially constant level of tension will depend on the characteristics of the web and the finishing operations performed. In a typical finishing line, the tension for very light weight webs such as tissue used to form airmail envelopes, will be set at a correspondingly low value, such as 0.3 pounds per linear inch (pounds-force divided by the width of the web in inches). For more conventional paper, the set value of the tension is set typically in the range of 2 to 5 lbs-force/linear inch. For heavier stock, such as cardboard products, the tension level in the web is normally set at a higher value, such as 15 lbf/linear inch. In each case, the tension should be sufficient only to facilitate the handling and finishing of the web, but not sufficient to stretch the web into registration as occurs in conventional printing and finishing equipment.

It is also significant that there is no slippage between the draw rolls and the web. The draw rolls act in cooperation with air loaded trolley nips 47 (FIG. 5) or opposed rolls which secure the web to travel in unison with the draw roll. Because in the preferred form all of the draw rolls are driven from a common line shaft, they rotate at substantially the same speed which avoids variations in the rate of travel of the web which can produce variations in the tension in the web. Stated in other terms, once a desired line of tension is set between the infeed 30 and the nip of the first draw roll 41 (as shown, at a chill roll 56), it is held substantially constant throughout the finishing line. This arrangement is in strong contrast to conventional registration arrangements which use an overdriven variable speed draw roll with slippage between the roll and the web to stretch the web into registration, or allow it to shrink back into registration as less overdrive is applied. It is noteworthy that applicants' system can include equipment such as an imager 46 that sprays ink onto the web under computer control and then dries the ink, and glue patterns applied by a segmented remoistenable gluer 48, in a dryer 50. The application of wet ink and glue and then the drying, induce some changes in the characteristics of the web. While the change in tension is comparatively minor, typically less than ±5%, it is automatically and continually compensated for by the infeed 30 so that the web leaving the chill rolls 56 is at the constant preselected value, despite the presence of moistening and drying operations in the finishing line. This arrangement is believed to be unique in that heretofore off-press finishing lines would not include a gluer and a dryer. As a result, segmented gluing was applied at the press before the web was rewound. This leads to the problem that the rewound web has a pattern of relatively thick glue which can cause the web to be wound in an uneven manner. The printing press can thus limit its functions to lithography.

The web finishing system also includes a pattern perforator 52, a sequential numbering unit 54, the chill roll 56 located after the dryer 50, a silicone applicator 58, a ribbon deck 60 that slits the web into plural parallel ribbons, a compensator unit 62 that maintains registration between parallel ribbons formed in the web, a rotary die cutter 64, an envelope gluer 66, plow stations 68, 70, 72 and 74 each with at least one draw roll powered from the main line shaft, and the rotary cutter 22 which has the final draw roll in the line.

As will be understood by those skilled in the art, the line illustrated in FIGS. 1, 2 and 5 is exemplary only. A wide flexibility exists in adding or deleting equipment from the line, or in selectively deactivating one or more pieces of equipment which are not required to produce a particular product. For example, if no die cuts are required, the die cutter 64 can be set "off impression" so that the web runs through the die cutter with no die cuts being made in the web. Certain of these pieces of equipment, the dryer, chill rolls, silicone applicator, ribbon deck, compensator, and the plow stations, operate on the web without regard to the location of printed matter on the web. They are registration insensitive. Other pieces of equipment, the pattern perforator, numbering unit, segmented gluer, die cutter, envelope gluer and rotary cutter are registration sensitive. Each has at least one function cylinder 76 that performs an operation on the web which must be precisely coordinated with the printed pattern of impressions on the web. As shown in FIGS. 4A, 4B and 5, on the rotary cutter the function cylinder carries the blade 22*a;* the operation of this function cylinder is a cut across the web. It should be noted that the plow stations 72 and 74 also include spot gluers 77,77 with associated function cylinders 76,76 powered through a secondary drive system 75. The spot gluers 77,77 are registration sensitive.

The secondary drive system 75 rotates all of the function cylinders 76. The secondary drive system preferably includes a second line shaft 80 driven by the main shaft 38 through a variable transmission 82. Gear boxes 84 transmit power from the shaft 80 to the function cylinders via shafts 86 and phasing gears 88. The transmission 82 produces variations in the ratio of the speeds of the shafts 38 and 80, regardless of which shaft is driven directly. This variation is continuous and it can keep up with cumulative errors where the impressions as unwound are printed consistently long or consistently short.

The control system of the present invention adjusts the speed of rotation of each function cylinder in coordination with the passage of an impression. An optical scanner 94 associated with and located at each function cylinder 76 senses the location of each impression on the web. For clarity, only two scanners 94 are shown in FIG. 2. One of them is shown again in FIG. 5. It will be understood that in the preferred form one such scanner is located adjacent each registration sensitive piece of equipment in the line. The scanners 94 also monitor each impression, as opposed to monitoring intermittently. No finishing line known to applicants monitors each impression. Suitable scanners 94 are sold by Web Printing Controls Co., Inc. of Barrington, Ill.

The speed of each function cylinder is measured by an associated encoder 96 of conventional construction that produces a known number of pulses during each complete revolution of the cylinder. The output of the encoders are applied over lines 97 to the processor 36. For each operation of the finishing line 10, it is known that a preselected number N of pulses is associated with the rotation of the function cylinder during the movement therethrough of one impression. For example, if one rotation of the function cylinder corresponds to one repeat length, the number of pulses produced during one complete revolution of the function cylinder equals N. The function cylinders are initially placed in register manually. Thereafter, variations in their speed of rotation can maintain that preset registration. In the event of a major shift in location, as due to a splice, the phasing gears also work to reestablish registration through a machine local phase (angular position) adjustment.

In operation, each scanner 94 looks at one registration mark as a START signal indicative of the beginning of an impression. The sensing of the next successive mark is read as a STOP indicative of the end of that impression (and the start of the next impression). The processor 36 computes and stores the elapsed time interval T. The value for this time interval T varies, assuming that the web is transported at a constant speed, in a manner that corresponds with the repeat length L of the impression passing under the scanner. The processor counts the number of pulses produced by the associated encoder 96 during the interval T. If the number of pulses is N, then no corrective output signal is generated. If the number is different than N, then the appropriate corrective signal is sent over line 92 to the associated motor 90 to speed up or slow down the associated function cylinder to bring it into registration. The direction of the correction, whether to speed or slow the function cylinder, corresponds to whether the comparison indicates that the impression is short or long. The magnitude of the error correction signal varies directly with the difference between the number of pulses sensed during the interval T and the number of pulses N corresponding to a registration condition. A typical value for N is 720.

To smooth the operation of this registration control, the processor 36 preferably sends a corrective signal which is the average of the signals produced by several impressions, preferably in the range of 10 to 20 successive impressions. Also, the processor will not produce an error corrective output signal if the sensed error exceeds preset limits, e.g. ±5% of N. For a 630 mm repeat length, 5% is about 31 mm, or about ±⅛ inch. Such large errors are associated with transitory conditions such as the passage of a splice or a length of web that is missing registration marks. Because no error signal is generated, the function cylinders continue to operate at the same speed as they had been operating. This means that the finishing line will most likely continue to operate in register, thereby avoiding the creating of waste scrap that would be produced if any adjustment were made. When the registration marks reappear, or once a splice has passed, the registration system senses the first two "regularly" spaced marks following the splice and produces an appropriate correction signal to begin to regain registration, whether through a continuous ratio adjustment to compensate for cumulative deviations in the repeat length of the impressions from the repeat length of the press cylinder, or through a phase adjustment to compensate for localized errors in the angular position of the function cylinders with respect to the impressions. There is waste during this reset, but it is significantly less than the waste when prior controls attempt to deal with these same problems.

The transmission 82 adjusts the relative speeds of rotation of the function cylinders in response to the error correction output signal on the line 100 which is responsive in turn to the error detection and control system just described. The signal controls the operation of motor 98 which makes the adjustment of the transmission. It corrects accumulating errors such as those illustrated in FIG. 3, whether due to variations in the repeat length due to the web material, atmospherics or the like, or to factors such as splices. The signal varies the transmission, and thereby speed of the cylinder and thus the relationship between the cylinder, and the pattern of impressions on the web. The controller 36 for the motors 98, is part of a closed loop servo drive system. Those skilled in the art will recognize a wide range of servo drive systems can be used; applicant prefers the finishing line servo drive system sold by P.I.D. System Engineering Corp. of San Carlos, Calif.

It should be noted that there is no physical limitation on the correcting movement of the transmission 82 (as with a movable dancer roll that adjust paper path length) other than the speed and responsiveness of the transmission itself. The variable transmission manufactured by Fairchild under its trade designation Speedcon is sufficiently fast and has a dynamic response time that keeps up with even substantial accumulating errors.

A registration adjustment can occur at the function cylinders because the operating element of the function cylinders, whether a knife blade, a die plate, a glue applicator, a numbering head, etc., makes only intermittent, very brief contact with the web. This is in contrast to the draw rolls, trolley nips, and printing cylinders which are in constant contact with the web. The difference in the surface speeds of the element and the web is so slight and over so brief an interval of contact that it has a negligible adverse affect on the quality of the operation being performed or on the web. This invention therefore cannot work in a printing press. Stated more generally, a fundamental difference of the present invention as compared to the techniques currently in use commercially is that in the present invention the functions are adjusted to the web, rather that adjusting the web to the function—typically by stretching the web into registration.

The present invention, in its preferred form, also makes rapid, dynamic phase adjustments at each registration sensitive piece of equipment. Specifically, the transmissions 88 acting under control of control signals was lines 92 from the controller 36 introduce a variable phase adjustment in the angular position of the associated function cylinder as compared with that of the second line shaft 80. Motors 90 operating in response to the control signals control the amount of phase shift introduced at the associated phasing gear 88. The control signals reflect readings from the associated scanners 94 and information regarding the angular position of the function cylinders derived from an initial "in registration" setting of the function cylinders and the subsequent tracking of their rotation using the speed measurement described above. Because the secondary line shaft rotates with a phase difference that adjusts for cumulative errors, the individual phasing gears 88 deal principally with "localized" errors, that is, shrinkages or stretching in the web, in any direction and of a wide variety of magnitudes, which appear only in a portion of the web. They also correct the angular position of the web following a splice, as necessary, where the adjustment is required by the splice, not the repeat length of the impressions printed on the web. These localized errors are not cumulative since they are not necessarily of the same type—a stretching or a shrinkage—and they often do not occur for a sufficient period of time to accumulate to a large net resultant error.

Known registration systems have been poorly equipped to deal with this type of error. One problem was that only one or two scanners were used and they monitored only one of every 10 to 100 impressions (as opposed to averaging readings from multiple impressions). This meant that a localized change would not be detected and corrected until after a considerable length of web had run out of register and may need to be scrapped. Another problem was the poor dynamic response of many standard phasing gears to the extremely rapid, and sometimes large, changes in the detected registration errors. In conventional systems, the errors would include cumulative errors, and would normally be beyond the capacity of the phasing gears to keep up with the required corrections, or the system would "hunt" in response to correction signals. With the present invention, the secondary drive with variable transmission 82 and phasing gears 88 corrects for the accumulating errors as well as localized errors without excessive hunting. The control system is therefore very stable.

In operation, the web finishing system 10 of the present invention transports a web at a preselected constant tension that is sufficient to handle and process the web, but which does not otherwise subject it to stress. The tension is set by an infeed unit operating in opposition to the draw rolls of the chill rolls, and then maintained by the no-slip drive at subsequent draw rolls. The tension in the web is not used to stretch the web to maintain registration between the web and position sensitive operations. Registration is maintained by sensing the position of the web, preferably of each impression and at each registration sensitive piece of equipment, and adjusting the speed of the function cylinders to the web. A scanner at each function cylinder senses accumulating errors and the controller produces a control signal that adjust the speed of rotation of the function cylinders to the pattern of impressions on the web to compensate for the error and thereby maintain registration. Large errors associated with splices and missing registration marks do not produce a correction signal for the function cylinders' speed. The function cylinders contact the web only intermittently. The system preferably includes phasing gears at each registration sensitive piece of equipment to correct for localized errors. The secondary line follows the main line shaft and rotates all the function cylinders in unison. The web transport system grips the web so there is no slippage between the web and the draw rolls of the web transport.

The control system operating with the web-finishing system described above can provide off-line finishing of pre-printed webs at a high speed and with an unusually high degree of reliability and accuracy. It is particularly successful in avoiding scrap waste due to splices and missing registration marks. More generally, it provides a highly stable, reliable and cost effective finishing system that provides all of these advantages while having a relatively low cost.

While the invention has been described with respect to its preferred embodiments, it will be understood that various modifications and alterations will occur to those skilled in the art from the foregoing detailed description and the accompanying drawings. For example, while the registration between the web and the function cylinders has been described as achieved using certain variable phase transmissions, other mechanical or even non-mechanical speed controls or direct drives may be used. Further, while the invention has been described as using encoders to measure the speed of the function cylinders, other devices and approaches are known which can accurately determine angular position and angular speed with the requisite degree of accuracy, reliability and resolution. Also, while the invention has been described with an optical scanner at each function cylinder that looks at each registration mark, it is possible to have one scanner serve two or more cylinders, or to have the scanners look at the registration marks only intermittently. Further, while the invention has been described with respect to comparing the speed of the function cylinders during the passage of one impression, the same approach can be used for a time interval corresponding to the passage of two or more impressions. These modifications, of course, reduce the responsiveness of the control system to some extent. Still further, while this invention has been described with reference to the control of registration along an entire off-press finishing line, it will be understood that it can, of course, be used on only a portion of a line, or on the entire line, but operating independently on different sections of the line, and with different web tension levels in those portions of the line. Therefore line should be construed as the entire line, or one or more parts of the line. These and other modifications and variations which will occur to those skilled in the art are intended to fall within the scope of the appended claims.

What is claimed is:

1. A system for maintaining the registration between i) a succession of impressions printed on a web of paper in a regularly repeated pattern extending along the web in a first direction coincident with the direction of movement of the web said web carrying registration marks associated with the impressions where the distance between adjacent marks is correlated with the repeat length of the impression and ii) the location on the web where at least one finishing machine, forming a finishing line, having at least one function cylinder performs an operation on the printed web at a position on the web which must be accurately correlated along the first direction with respect to said repeated pattern, comprising means for transporting the web through the finishing line with a constant tension in the web, said tension being sufficient to maintain the web taut to facilitate its handling, but introducing no substantial elongation of the web in said first direction, means for driving said at least one function cylinder, means for monitoring the registration and generating a signal corresponding to any misregistration only when the magnitude of said misregistration is less than a predetermined limit, and means for adjusting the speed of rotation of said at least one function cylinder with respect to said web in response to said signal to correct said misregistration, said function cylinders making contact with and operating on the web intermittently.

2. The registration system according to claim 1 wherein the finishing line comprises plural finishing machines each of which has at least one function cylinder and wherein said driving means includes a main line shaft and a second line shaft that transmits rotary power to each of said associated function cylinders and wherein said adjusting means includes a variable transmission that transmits rotary power between said main line shaft and said second line shaft.

3. The system of claim 1 or 2 wherein said monitoring means comprises means for sensing said registration marks, means for measuring the speed of rotation of said at least one function cylinder, and electronic means for comparing (i) the speed of said function cylinder during the time for one impression to pass a predetermined position on said line with (ii) the known speed corresponding to one impression, and (iii) generating said signal to correspond to the magnitude of any difference in these speeds provided the difference does not exceed in magnitude a predetermined limit.

4. The system according to claim 3 wherein said means for measuring the speed of said function cylinder comprises an encoder associated with each function cylinder that produces N pulses during each cycle of operation of the function cylinder when it is in registration with one of the impressions.

5. The system according to claim 3 wherein said registration mark sensing means comprises an optical scanner associated with each of said function cylinders.

6. A process for maintaining registration in a web finishing system between (i) a series of impressions printed in a regular, repeating pattern along the length of a web that is moving along its length and (ii) the point of operation on the web of a series of function machines having operating elements mounted on rotatable function cylinders which intermittently perform the operation as the web moves therethrough, comprising the steps of:

setting a substantially constant tension in said web at a value sufficient to facilitate handling of the web but not large enough to produce any significant elongation of the web, transporting said web through the finishing system at said substantially constant tension, restraining the web against slippage with respect to elements in contact with the web performing said transporting, sensing the passage of at least one printed impression on the web without measuring its actual length, measuring the rotation of the function cylinders during said passage, producing an electrical control signal in response to a comparison of said measuring with a known value corresponding to the impression being in register, and adjusting the relative speed of the driven cylinders of said finishing machines with respect to the speed of said transporting in response to said electrical control signal to maintain said registration, provided said electrical control signal does not exceed in magnitude the predetermined limit.

7. The registration maintaining process of claim 6 wherein said adjusting comprises measuring the time interval T corresponding to the movement of at least one impression past a point on said line, measuring the speed of rotation of the function cylinder during said interval T, comparing said measured speed with a known speed corresponding to said function cylinder being in registration with said pattern of impressions, generating said signal which corresponds to the magnitude and direction of the error, and transmitting said signal if it does not exceed in magnitude a predetermined limit.

* * * * *